US011769439B2

(12) United States Patent
Xiao et al.

(10) Patent No.: US 11,769,439 B2
(45) Date of Patent: Sep. 26, 2023

(54) METHOD AND DEVICE FOR ADJUSTING DISPLAY PARAMETER, AND DISPLAY DEVICE

(71) Applicant: BOE Technology Group Co., Ltd., Beijing (CN)

(72) Inventors: Xiangchun Xiao, Beijing (CN); Fan Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/802,331

(22) PCT Filed: Feb. 25, 2021

(86) PCT No.: PCT/CN2021/077907
§ 371 (c)(1),
(2) Date: Aug. 25, 2022

(87) PCT Pub. No.: WO2021/170040
PCT Pub. Date: Sep. 2, 2021

(65) Prior Publication Data

US 2023/0100868 A1 Mar. 30, 2023

(30) Foreign Application Priority Data

Feb. 27, 2020 (CN) ..... 202010125640.0

(51) Int. Cl.
*G09G 3/20* (2006.01)
*G09G 3/34* (2006.01)

(52) U.S. Cl.
CPC ..... *G09G 3/2007* (2013.01); *G09G 3/3406* (2013.01); *G09G 2320/0626* (2013.01); *G09G 2320/0666* (2013.01); *G09G 2360/16* (2013.01)

(58) Field of Classification Search
CPC ..... G09G 3/2007; G09G 3/3406; G09G 2320/0626; G09G 2320/0666; G09G 2360/16; G09G 2360/144
See application file for complete search history.

(56) References Cited

U.S. PATENT DOCUMENTS 10,725,334 B2 * 7/2020 Huang ..... H01L 33/504
2005/0128313 A1 6/2005 Kobayashi
(Continued)

FOREIGN PATENT DOCUMENTS

CN 101191926 A 6/2008
CN 103489430 A 1/2014
(Continued)

OTHER PUBLICATIONS

International Search Report dated May 21, 2021, issued in counterpart Application No. PCT/CN2021/0779097 with English translation. (8 pages).
(Continued)

*Primary Examiner* — Antonio Xavier
(74) *Attorney, Agent, or Firm* — WHDA, LLP

(57) ABSTRACT

A method and device for adjusting a display parameter, and a display device. An ambient brightness level is used as a criterion to adjust a brightness level of an intermediate gray level of a displayed image, such that a corresponding display parameter can be adjusted to be closer to the criterion within an appropriate allowable floating range, thereby providing a displayed image that is safe and comfortable for the eyes. The method comprises: detecting an ambient brightness level (101); determining an adjustment parameter of a display device corresponding to a preset condition, the preset condition comprising a difference between a brightness level of an intermediate gray level of the display device and the ambient brightness level being less than or equal to a preset brightness value (102); and adjusting, according to
(Continued)

the adjustment parameter, brightness levels of at least a portion of gray levels of the display device (103).

18 Claims, 2 Drawing Sheets

(56) References Cited

U.S. PATENT DOCUMENTS

| | | | | |
|---|---|---|---|---|
| 2012/0154355 | A1 | 6/2012 | Kawai et al. | |
| 2016/0351133 | A1 | 12/2016 | Kim et al. | |
| 2019/0287478 | A1 | 9/2019 | Yu et al. | |
| 2020/0027941 | A1* | 1/2020 | Luan | G09G 3/3233 |

FOREIGN PATENT DOCUMENTS

| | | | |
|---|---|---|---|
| CN | 104916259 | A | 9/2015 |
| CN | 105118433 | A | 12/2015 |
| CN | 105304066 | A | 2/2016 |
| CN | 105489193 | A | 4/2016 |
| CN | 105788566 | A | 7/2016 |
| CN | 106057169 | A | 10/2016 |
| CN | 108615511 | A | 10/2018 |
| CN | 109326250 | A | 2/2019 |
| CN | 110275296 | A | 9/2019 |
| JP | 2005165116 | A | 6/2005 |
| JP | 2011112961 | A | 6/2011 |

OTHER PUBLICATIONS

Written Opinion dated May 21, 2021, issued in counterpart Application No. PCT/CN2021/077907, with English Translation. (11 pages).

* cited by examiner

METHOD AND DEVICE FOR ADJUSTING DISPLAY PARAMETER, AND DISPLAY DEVICE

CROSS REFERENCE TO RELEVANT APPLICATIONS

The present disclosure claims the priority of the Chinese patent application filed on Feb. 27, 2020 before the Chinese Patent Office with the application number of 202010125640.0 and the title of "METHOD AND DEVICE FOR ADJUSTING DISPLAY PARAMETER, AND DISPLAY DEVICE", which is incorporated herein in its entirety by reference.

TECHNICAL FIELD

The present disclosure relates to the technical field of displaying, and more particularly, to a displaying-parameter adjusting method and apparatus and a displaying device.

BACKGROUND

Nowadays, people pay more attentions to the injury caused by the displaying devices to human eyes. Therefore, many displaying devices employ means such as reducing the color temperature and providing an eye-protection mode, to reduce the main component in the light rays that has the major injuring on human eyes, i.e., blue light, thereby reducing the injuring on human eyes by the displaying devices.

However, the blue light among the blue lights emitted by displaying devices that truly injures the retinas is the blue light that passes through the pupils and reaches the eye base retinas. Therefore, merely reducing the emission amount of the blue light may not ensure that the radiation amount of the blue light that reaches the eye bases reduced. For example, in a dark environment, the human-eye pupils dilate, and the light input is in direct proportion to the square of the diameter of the pupils. Regarding the same one frame, the radiation amount of the blue light that reaches the eye base is considerably higher than the radiation amount of the blue light when the diameter of the human-eye pupils is smaller in an official environment, and causes much higher injuring to human eyes.

SUMMARY

According to the first aspect of the present disclosure, there is provided a displaying-parameter adjusting method, wherein the method includes:

detecting an ambient brightness;

determining adjustment parameters of a displaying device corresponding to a predetermined condition, wherein the predetermined condition includes that a difference between a brightness of an intermediate grayscale of the displaying device and the ambient brightness is less than or equal to a preset brightness value; and adjusting a brightness of at least some of grayscales of the displaying device according to the adjustment parameter.

Optionally, the step of determining the adjustment parameter of the displaying device corresponding to the predetermined condition includes:

determining a brightness of a maximum grayscale of the displaying device corresponding to the predetermined condition; and according to a preset first correspondence relation between grayscale brightnesses and backlight driving parameters, determining a first backlight driving parameter corresponding to the brightness of the maximum grayscale, and using the first backlight driving parameter as the adjustment parameter.

Optionally, the step of, according to the adjustment parameter, adjusting the brightness of the at least some of the grayscales of the displaying device includes:

driving a backlight module of the displaying device according to the first backlight driving parameter, so that the difference between the brightness of the intermediate grayscale and the ambient brightness is less than the preset brightness value.

Optionally, when a driving type of the backlight module is voltage driving, the backlight driving parameter is a duty ratio of a driving-voltage signal of the backlight module.

Optionally, when a driving type of the backlight module is current driving, the backlight driving parameter is a driving current of the backlight module.

Optionally, the step of determining the adjustment parameter of the displaying device corresponding to the predetermined condition includes:

determining a ratio of the ambient brightness to the brightness of the intermediate grayscale before the adjustment, to obtain an adjustment proportion of the displaying device;

determining a product of a first brightness of a target grayscale before the adjustment with the adjustment proportion, to obtain a second brightness of the target grayscale, wherein the target grayscale is any one of grayscales of the displaying device or any one of grayscales to be displayed; and according to a preset second correspondence relation between the grayscales and the brightnesses before the adjustment, determining an original grayscale corresponding to the second brightness, and using the original grayscale as the adjustment parameter.

Optionally, the step of, according to the adjustment parameter, adjusting the brightness of the at least some of the grayscales of the displaying device includes:

displaying at a brightness of the original grayscale when a displaying condition of the target grayscale is satisfied.

Optionally, the step of, when the displaying condition of the target grayscale is satisfied, displaying at the brightness of the original grayscale includes:

displaying at the brightness of the original grayscale when displaying data of a frame to be displayed include the target grayscale.

Optionally, the preset brightness value is greater than or equal to 0.2 times the ambient brightness, and less than or equal to 1.6 times the ambient brightness.

Optionally, the method further includes:

adjusting a color temperature of the displaying device according to a preset sunlight color temperature.

Optionally, the step of, adjusting the color temperature of the displaying device according to the preset sunlight color temperature includes:

adjusting an RGB gain parameter of the displaying device to be a preset RGB gain parameter corresponding to the preset sunlight color temperature.

Optionally, the preset sunlight color temperature is greater than or equal to 6000K, and less than or equal to 7200K.

Optionally, the preset sunlight color temperature is 6700K.

Optionally, the step of, according to the adjustment parameter, adjusting the brightness of the at least some of the grayscales of the displaying device includes:

acquiring a blue-light-radiation-exposure value of the displaying device, wherein the blue-light-radiation-exposure value is for characterizing a level of radiation injury on human eyes by blue light of the displaying device; and according to the adjustment parameter and the blue-light-radiation-exposure value, adjusting the brightness of the at least some of the grayscales of the displaying device, so that the blue-light-radiation-exposure value is less than a preset standard value.

Optionally, the preset standard value is 1 $W/m^2$.

Optionally, the step of acquiring the blue-light-radiation-exposure value of the displaying device includes:

calculating the blue-light-radiation-exposure value by using the following formula:

$L_B=\Sigma_{300}^{700} L_\lambda \cdot B(\lambda) \cdot L\lambda$, wherein $L_B$ is the blue-light-radiation-exposure value, $\lambda$ is a wavelength of a scanning spectrum, a value of A is greater than or equal to 300 nm, and less than or equal to 700 nm, $L_\lambda$ is a radiation brightness of a light whose wavelength is $\lambda$, $B(\lambda)$ is a preset coefficient of the light whose wavelength is $\lambda$, and $\Delta\lambda$ is a scanning interval of spectrum scanning.

Optionally, the displaying device is provided with a brightness detecting device, and the step of detecting the ambient brightness includes:

determining the ambient brightness according to target light rays collected by the brightness detecting device, wherein the target light rays are light rays that are diffusively reflected at a surface of an object around the displaying device.

Optionally, a light entrance of the brightness detecting device directly faces a diffusely reflecting surface, and a solid angle of incidence of the target light rays from the diffusely reflecting surface to the brightness detecting device is greater than 1 sr.

Optionally, the step of detecting the ambient brightness includes:

acquiring an illuminance value of the diffusely reflecting surface directly facing the displaying device; and determining a ratio of the illuminance value to $\pi$ as the ambient brightness.

Optionally, the step of detecting the ambient brightness includes:

based on a pre-stored correspondence relation between environments and brightnesses, determining a target brightness corresponding to a usage environment of the displaying device; and determining the target brightness to be the ambient brightness.

Optionally, when the usage environment of the displaying device is a learning-or-official environment, the ambient brightness is a ratio of a target illuminance to $\pi$, wherein the target illuminance is an illuminance value in a horizontal direction at a watching height above a ground by 120 cm.

Optionally, the target illuminance is 200 lx.

According to the second aspect of the present disclosure, there is provided a displaying-parameter adjusting apparatus, wherein the apparatus includes:

a detecting module configured for detecting an ambient brightness;

a determining module configured for determining adjustment parameters of a displaying device corresponding to a predetermined condition, wherein the predetermined condition includes that a difference between a brightness of an intermediate grayscale of the displaying device and the ambient brightness is less than or equal to a preset brightness value; and a first adjusting module configured for, adjusting a brightness of at least some of grayscales of the displaying device according to the adjustment parameter.

According to the third aspect of the present disclosure, there is provided a displaying device, wherein the displaying device performs displaying-parameter adjustment by using the displaying-parameter adjusting method according to the first aspect.

Optionally, the displaying device includes a backlight module, and a ratio of a sum of powers of first light-source wave bands of a light source of the backlight module to a sum of powers of second light-source wave bands is less than 50%; and the first light-source wave bands are greater than or equal to 415 nm, and less than or equal to 455 nm, and the second light-source wave bands are greater than or equal to 400 nm, and less than or equal to 500 nm.

According to the fourth aspect of the present disclosure, there is provided a calculating and processing device, wherein the calculating and processing device includes:

a memory storing a computer-readable code; and one or more processors, wherein when the computer-readable code is executed by the one or more processors, the calculating and processing device implements the displaying-parameter adjusting method according to the first aspect.

According to the fifth aspect of the present disclosure, there is provided a computer program, wherein the computer program includes a computer-readable code, and when the computer-readable code is executed in a calculating and processing device, the computer-readable code causes the calculating and processing device to implement the displaying-parameter adjusting method according to the first aspect.

According to the sixth aspect of the present disclosure, there is provided a nonvolatile computer-readable storage medium, wherein the nonvolatile computer-readable storage medium stores the computer program according to the fifth aspect.

The above description is merely a summary of the technical solutions of the present disclosure. In order to more clearly know the elements of the present disclosure to enable the implementation according to the contents of the description, and in order to make the above and other purposes, features and advantages of the present disclosure more apparent and understandable, the particular embodiments of the present disclosure are provided below.

BRIEF DESCRIPTION OF THE DRAWINGS

In order to more clearly illustrate the technical solutions of the embodiments of the present disclosure or the related art, the figures that are required to describe the embodiments or the related art will be briefly introduced below. Apparently, the figures that are described below are embodiments of the present disclosure, and a person skilled in the art may obtain other figures according to these figures without paying creative work.

DETAILED DESCRIPTION OF THE EMBODIMENTS

In order to make the above purposes, features and advantages of the present disclosure more apparent and understandable, the present disclosure will be described in further detail below with reference to the drawings and the particular embodiments.

Figure 1:
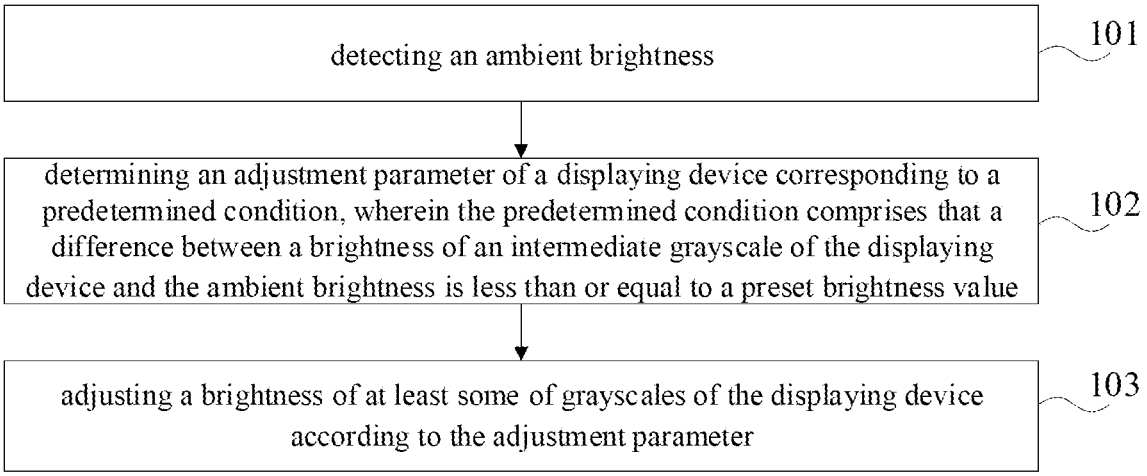
FIG. 1 shows a flow chart of the displaying-parameter adjusting method according to an embodiment of the present disclosure.

Referring to FIG. 1, FIG. 1 schematically shows a flow chart of a displaying-parameter adjusting method. The method includes the following steps:

Step 101: detecting an ambient brightness.

In an embodiment of the present disclosure, the displaying device may be installed with an ambient-brightness detecting device, such as a luminance sensor, whereby the displaying device may detect the ambient brightness of the displaying environment by using the luminance sensor. In practical applications, the ambient-brightness detecting device may include a standard white plate configured for reflecting a large amount of ambient light to the luminance sensor. Due to the white color absorbs little light rays, by detecting the brightness of the ambient light reflected by the standard white plate, the accuracy of the detection on the ambient brightness may be increased.

The purpose of the detection on the ambient brightness is to acquire the parameters of the natural light of the equal brightness, that's because human eyes may automatically adjust the size of the pupils to enable the luminous flux entering the eyes to be within a range which is innocuous to the human eyes according to the magnitude of the ambient brightness. Therefore, the brightness of the natural light of the equal brightness, and the wavelength components thereof, especially the blue-light component, may be configured as the optimum standard of displaying. At this point, when the average brightness of displaying and the magnitude of the injuring index of the blue-light component are close to those of the natural light of the brightness, then the displaying luminous flux entering the eyes is uninjurious to human eyes and makes a comfortable feeling.

Step 102: determining an adjustment parameter of a displaying device corresponding to a predetermined condition, wherein the predetermined condition includes that a difference between a brightness of an intermediate grayscale of the displaying device and the ambient brightness is less than or equal to a preset brightness value.

In an embodiment of the present disclosure, the predetermined condition may indicate that the brightness of the intermediate grayscale of the displaying device approaches the ambient brightness. The displaying device may determine how much the adjustment parameter corresponding to the displaying device should be when the brightness of the intermediate grayscale approaches the ambient brightness. If the adjustment on the grayscale brightness is performed according to the adjustment parameter subsequently, then the brightness of the intermediate grayscale may approach the ambient brightness.

Optionally, the preset brightness value may be greater than or equal to 0.2 times the ambient brightness, and less than or equal to 1.6 times the ambient brightness. In practical applications, the preset brightness value may also be adjusted according to the difference in the displayed frames, i.e., different demands on displaying, which is not particularly limited in the embodiments of the present disclosure. For example, regarding a frame of a painting work such as a traditional Chinese painting, the preset brightness value may be greater than or equal to 0.2 times the ambient brightness, and less than or equal to 0.4 times the ambient brightness. Regarding a frame such as a video and a photograph, the preset brightness value may be greater than or equal to 0.8 times the ambient brightness, and less than or equal to 1.6 times the ambient brightness.

Optionally, the predetermined condition may be that the brightness of the intermediate grayscale of the displaying device is equal to the ambient brightness. In other words, the difference between the brightness of the intermediate grayscale of the displaying device and the ambient brightness may be equal to zero.

The intermediate-grayscale frame represents the intermediate point of the sensing of brightness by human eyes, and also the physiological-equilibrium point when human eyes adapt the average brightness of the current environment. When the brightness of the intermediate-grayscale of the displayed frame is consistent with the physiological-equilibrium point of the adaptation of the human eyes in that environment, the sensing to the frame is more comfortable and more natural. Therefore, the method may use the natural optical environment where the displaying device is located as the adjustment standard, and adjust the corresponding displaying parameter by using a suitable permitted fluctuation range to approach the standard, to implement the effect that the displayed image makes no injuring on human eyes and brings a comfortable feeling. By adjusting the grayscale brightness, the brightness of the intermediate grayscale may approach the ambient brightness, whereby the human eyes may be more comfortable when sensing the frame. Accordingly, the pupils of the human eyes may not easily stimulate to dilate, and accordingly the radiation amount of the blue light that reaches the eye base retina via the pupils may be reduced, thereby reducing the injuring on the human eyes by the blue light.

Particularly, this step may be implemented by using the following two modes:

The first implementation includes the following steps:

determining a brightness of a maximum grayscale of the displaying device corresponding to the predetermined condition; and according to a preset first correspondence relation between grayscale brightnesses and backlight driving parameters, determining a first backlight driving parameter corresponding to the brightness of the maximum grayscale, and using the first backlight driving parameter as the adjustment parameter.

The first implementation is a mode of adjustment based on hardware. Due to grayscale may represent the grade of the brightness of the displaying device, the backlight brightness of the displaying device may decide the brightness of the maximum grayscale, or, in other words, decide the maximum brightness of displaying. When the brightness of the maximum grayscale is determined, then the brightnesses of the other grayscales may also be determined correspondingly according to the grayscale quantity of the displaying device. Therefore, when the predetermined condition that the brightness of the intermediate grayscale approaches the ambient brightness is to be satisfied, then it may be firstly determined how much the brightness corresponding to the maximum grayscale of the displaying device should be if the brightness of the intermediate grayscale is to approach the ambient brightness, and subsequently it may be determined how much the first backlight driving parameter corresponding to the brightness of the maximum grayscale corresponding to the predetermined condition should be. When the backlight module of the displaying device is driven according to the first backlight driving parameter subsequently, then the brightness of the maximum grayscale may be equal to the brightness that should be reached, which indirectly enables the brightness of the intermediate grayscale to approach the ambient brightness. The other grayscales are adjusted correspondingly in an equal proportion.

A first correspondence relation between different grayscale brightnesses and backlight driving parameters may be pre-stored in advance, and when the brightness of the maximum grayscale is required to reach a certain brightness, the backlight driving parameter that enables the brightness of the maximum grayscale to reach that brightness may be determined by table checking. An electric brightness parameter (which may generally be a voltage or a current) detected by the ambient-brightness detecting device, by conversion of analog signal/digital signal (Analogue/Digital, A/D), may be converted into a brightness parameter in the form of a digital signal, and, correspondingly, the grayscale brightnesses in the first correspondence relation may be expressed by the brightness parameters in the form of a digital signal. Subsequently, the backlight brightness of the displaying device may be adjusted according to the first correspondence relation, to make the brightness of the intermediate grayscale is equal to the detected ambient brightness. By means of adjusting the backlight brightness, the brightnesses of all of the grayscales of the displaying device may be adjusted.

When the mechanisms of the driving of the backlight module are different, the backlight driving parameters are different. For example, when a driving type of the backlight module is voltage driving, the backlight driving parameter is a duty ratio of a driving-voltage signal of the backlight module. Regarding a voltage-driven-type backlight module, different backlight brightnesses may be implemented by adjusting the duty ratio of the Pulse Width Modulation (PWM); in other words, the backlight driving parameter may be the duty ratio of the backlight-driving-voltage signal. When a driving type of the backlight module is current driving, the backlight driving parameter is a driving current of the backlight module. Regarding a current-driven-type backlight module, different backlight brightnesses may be implemented by adjusting the magnitude of the backlight driving current; in other words, the backlight driving parameter may be the backlight driving current. Regarding the displaying devices of other types, different embodiments may be used according to their different mechanisms of light emission.

The second implementation includes the following steps:

determining a ratio of the ambient brightness to the brightness of the intermediate grayscale before the adjustment, to obtain an adjustment proportion of the displaying device: determining a product of a first brightness of a target grayscale before the adjustment with the adjustment proportion, to obtain a second brightness of the target grayscale, wherein the target grayscale is any one of grayscales of the displaying device or any one of grayscales to be displayed: and according to a preset second correspondence relation between the grayscales and the brightnesses before the adjustment, determining an original grayscale corresponding to the second brightness, and using the original grayscale as the adjustment parameter.

The second implementation is a mode of adjustment based on software, i.e., increasing or reducing the grayscale value of the grayscale to be displayed. Particularly, in other words, by determining which of the grayscales before the adjustment corresponds to the brightness of each of the target grayscales after the adjustment, when the target grayscale is required to be displayed, it is merely required to display by using the brightness of the corresponding grayscale before the adjustment. For example, the brightness x of the target grayscale $L_{134}$ after the adjustment corresponds to the original grayscale $L_{150}$ before the adjustment; in other words, the brightness that the grayscale $L_{150}$ originally corresponds to is x. Accordingly, when the target grayscale $L_{134}$ is required to be displayed, it may be displayed by using the brightness x of the grayscale $L_{150}$; in other words, the brightness of the target grayscale $L_{134}$ may be set to be x. The ratio of the ambient brightness to the brightness of the intermediate grayscale before the adjustment is also the adjustment proportion that enables the brightness of the intermediate grayscale to approach the ambient brightness, and, correspondingly, the second brightness that the target grayscale should reach after the adjustment is also the product of the first brightness of the target grayscale before the adjustment with the adjustment proportion, whereby the brightness of the target grayscale may be adjusted with the brightness of the intermediate grayscale in an equal proportion.

The target grayscale may be any one of the grayscales of the displaying device. In other words, it may be determined how much the brightnesses of all of the grayscales of the displaying device after the adjustment should be, i.e., the second brightness, and subsequently the grayscale values of the original grayscale corresponding to the second brightness of all of the grayscales are determined. In other words, all of the grayscales may be calculated in advance, and in subsequent displaying, it is merely required to display by using the brightness of the calculated original grayscale, so that when the ambient brightness is constant for a long time, it may save the time for the calculation, and improve the efficiency of displaying.

Certainly, the target grayscale may also be any one of the grayscales to be displayed. In other words, when the displaying device requires to display one of the grayscales, the original grayscale corresponding to the second brightness of that grayscale is calculated out in real time. The ambient brightness may change quickly, and therefore the ratio of the ambient brightness to the brightness of the intermediate grayscale before the adjustment also changes constantly. Therefore, the grayscale to be displayed may be calculated in real time, which may improve the efficiency of displaying.

For example, when the maximum grayscale of the displaying device (such as a television set) is 255, the brightness $L_{max}$ of the maximum grayscale and the brightness of the intermediate grayscale 127 satisfy the relation of: $L_{max}=L_{127}*(2\gamma)$, wherein the value of $\gamma$ is related to the environment; for example, in a living-room environment, the y value may generally be 2.2. When the ambient brightness is 50 nit, the brightness of the intermediate-grayscale $L_{127}$ may be equal to the ambient brightness 50 nit, and accordingly $L_{max}$ is approximately 230 nit. Moreover, the maximum brightness of current common television sets is approximately 350 nit to 450 nit. By using such a mode of adjustment, the blue-light radiation amount may be reduced by ⅓-½.

Moreover, in the above two modes, due to the brightnesses of all of the target grayscales are adjusted in an equal proportion, the contrast of the displaying device is not influenced.

Step 103: adjusting a brightness of at least some of grayscales of the displaying device according to the adjustment parameter.

In an embodiment of the present disclosure, as corresponding to the two implementations in the step 102, the step also has two implementations.

As corresponding to the first implementation in the step 102, the step 103 may be implemented by using the following step:

driving a backlight module of the displaying device according to the first backlight driving parameter, so that the difference between the brightness of the intermediate grayscale and the ambient brightness is less than the preset brightness value.

Because the first backlight driving parameter is the backlight driving parameter corresponding to the brightness of the maximum grayscale when the brightness of the intermediate grayscale approaches the ambient brightness, by driving the backlight module of the displaying device according to the first backlight driving parameter, the brightness of the maximum grayscale may be equal to the brightness that should be reached when the predetermined condition is satisfied, whereby the predetermined condition that the brightness of the intermediate grayscale approaches the ambient brightness is indirectly satisfied. The other grayscales are adjusted correspondingly in an equal proportion.

As corresponding to the second implementation in the step 102, the step 103 may be implemented by using the following step:

displaying at a brightness of the original grayscale when a displaying condition of the target grayscale is satisfied. Particularly, this step includes, displaying at the brightness of the original grayscale when displaying data of a frame to be displayed include the target grayscale.

Before displaying a frame, the displaying device may firstly prepare all of the displaying data of that frame, which may include the grayscales corresponding to each of the pixels in that frame. If the displaying data of the frame to be displayed include the target grayscale, that indicates that the displaying condition of the target grayscale is satisfied, and accordingly the displaying device may display by using the brightness of the original grayscale corresponding to the second brightness of the target grayscale. If the target grayscale is the intermediate grayscale, then, in displaying, the brightness of the intermediate grayscale approaches the ambient brightness.

It should be noted that, in practical applications, it may be determined, according to the use of the displaying device, whether the grayscale brightness is adjusted before leaving factory, or the grayscale brightness is adjusted in real time according to the ambient brightness after leaving factory. If the displaying environment is fixed, or, in other words, the ambient brightness is constant, then the brightnesses of all of the grayscales may be adjusted and fixed according to the constant ambient brightness before leaving factory. If the ambient brightness of the displaying environment is not constant, then the grayscale brightness may be adjusted automatically in the displaying process according to the data detected by the ambient-brightness detecting device, which is not particularly limited in the embodiments of the present disclosure.

Optionally, the step 103 may be implemented by using the following steps: acquiring a blue-light-radiation-exposure value of the displaying device, wherein the blue-light-radiation-exposure value is for characterizing a level of radiation injury on human eyes by blue light of the displaying device: and adjusting the brightness of the at least some of the grayscales of the displaying device according to the adjustment parameter and the blue-light-radiation-exposure value, to make the blue-light-radiation-exposure value is less than a preset standard value. The preset standard value may be 1 W/m$^2$. The blue-light-radiation-exposure value may be calculated by using the following formula:

$L_B=\Sigma_{300}^{700} L_\lambda \cdot B(\lambda) \cdot L\lambda$, wherein $L_B$ is the blue-light-radiation-exposure value, $\lambda$ is a wavelength of a scanning spectrum, a value of $\lambda$ is greater than or equal to 300 nm, and less than or equal to 700 nm, $L_\lambda$ is a radiation brightness of a light whose wavelength is $\lambda$, $B(\lambda)$ is a preset coefficient of the light whose wavelength is $\lambda$, and $\Delta\lambda$ is a scanning interval of spectrum scanning.

Optionally, in particular applications, third grades of targets of displaying may be used:

1. Forbidden grade: In accordance with the requirements by the IEC TR 62471 standard, the blue-light-radiation-exposure value $L_B$ of the displaying device shall comply with the following standard:

$$L_B<1 \text{ W/m}^2.$$

The blue-light-radiation-exposure value may characterize the level of the radiation injury on human eyes by the blue light of the displaying device. Therefore, in the adjustment of the displaying brightness, the blue-light-radiation-exposure value of the displaying device may be controlled to always satisfy the above standard, which may prevent the injuring on the human eye by the blue light.

The blue-light-radiation-exposure value of the displaying device may be obtained by weighting by using the following formula after spectrum scanning of the radiation brightness is performed in advance, and stored in the displaying device.

$$L_B=\Sigma_{300}^{700} L_\lambda \cdot B(\lambda) \cdot L\lambda.$$

300 nm and 700 nm are the boundary values of the wave band of the scanning spectrum; in other words, the spectrum scanning is performed to the wave band greater than or equal to 300 nm and less than or equal to 700 nm.

2. Environmental grade: the brightness of the intermediate-grayscale $L_{mid}=L_{environment}$ ($L_{environment}$ is the ambient brightness). That basically ensures that the radiation of the displaying brightness does not exceed the overall environment.
3. Comfortable grade: the brightness of the maximum grayscale $L_{max}=L_{environment}$. That ensures that the displaying brightness does not exceed the maximum reflected-light intensity of the displaying background environment, the effect of displaying is close to that of a non-luminous body, and human eyes feel comfortable and does not easily get fatigued after long-term watching.

Generally, people may select the displaying brightness between the comfortable grade and the environmental grade, and, regarding long-term and short-distance watching, a brightness close to the comfortable grade may be selected.

In the environmental grade and the comfortable grade, their comfortableness levels may be graded according to the degree at which the brightness approaches the ambient light, whereby the vague anti-fatigue function has a quantifiable evaluation system, which facilitates improving the quality of displaying. When merely the brightness fatigue is taken into consideration, the grading is as follows:

$L_{max}<1.5\ L_{environment}$ is the first grade of comfortableness;

$1.5\ L_{environment}<L_{max}<2\ L_{environment}$ is the second grade of comfortableness;

$2L_{environment}<L_{max}<3\ L_{environment}$ is the third grade of comfortableness;

$3\ L_{environment}<L_{max}<4\ L_{environment}$ is the fourth grade of comfortableness; and $L_{max}>4\ L_{environment}$ is the fifth grade of comfortableness.

The fourth to the fifth grades of comfortableness are suitable to exhibit those contents where the image includes a luminous body. The first to the second grades of comfortableness are suitable to exhibit those contents where the image does not include a luminous body. The third grade of comfortableness is suitable to exhibit mixed contents.

If the blue-light injuring is also taken into consideration, the environment factor H of the displaying device may be obtained according to the ratio of the displaying brightness $L_s$ to the ambient brightness $L_{environment}$, i.e., $H=L_s/L_{environment}$, wherein $L_s$ is the displaying brightness of the displaying device when the radiation-exposure value of the displaying device displaying a totally white frame and the radiation-exposure value of the ambient light are equal. Accordingly, an anti-blue-light comfortableness grade standard may be formed by the following grading:

$L_{max}<1.5\ H*L_{environment}$ is the first grade of anti-blue-light comfortableness;

$1.5\ H*L_{environment}<L_{max}<2\ H*L_{environment}$ is the second grade of anti-blue-light comfortableness;

$2\ H*L_{environment}<L_{max}<3\ H*L_{environment}$ is the third grade of anti-blue-light comfortableness:

$3\ H*L_{environment}<L_{max}<4\ H*L_{environment}$ is the fourth grade of anti-blue-light comfortableness; and $L_{max}>4\ H*L_{environment}$ is the fifth grade of anti-blue-light comfortableness.

It may be understood that the first grade is the optimum anti-blue-light comfortableness eye-protection grade, the second grade is the second optimum grade, and the rest may be done in the same manner. Such a quantized graded evaluation facilitates distinguishing the anti-fatigue capabilities of the displaying device, to facilitate improving the displaying device.

Figure 2:
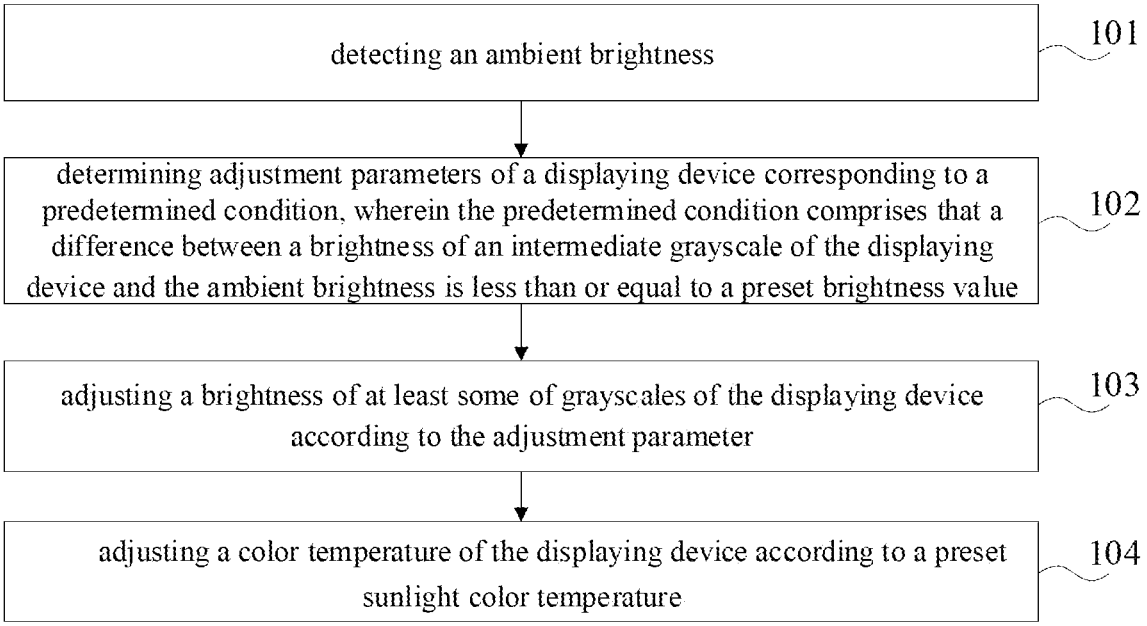
FIG. 2 shows a flow chart of the displaying-parameter adjusting method according to another embodiment of the present disclosure.

FIG. 2 schematically shows a flow chart of the steps of another displaying-parameter adjusting method. Referring to FIG. 2, the method may further include the following step:

Step 104: adjusting a color temperature of the displaying device according to a preset sunlight color temperature.

Particularly, the color temperature of the displaying device may be adjusted by adjusting the gains of the RGB (red-green-blue) three-color lights. By reducing the gain of the blue light, the color temperature may be reduced, and the radiation intensity of the overall blue light is reduced. Therefore, this step may be particularly implemented by using the step of: adjusting an RGB gain parameter of the displaying device to be a preset RGB gain parameter corresponding to the preset sunlight color temperature.

The preset sunlight color temperature may be set according to the color temperature of sunlight, 6700 Kelvins (K). Optionally, the preset sunlight color temperature is greater than or equal to 6000K, and less than or equal to 7200K. That may enable the color temperature of the displayed frame to approach approximately the color temperature 6700K of sunlight, whereby the color temperature of the frame maintains a nature-like state. Particularly, the preset sunlight color temperature may be 6700K.

Further optionally, the displaying device may further be provided with a displayed-page-mode reminding function. The reminding function may remind the operator to use a window-background darkening mode and a working-page darkening mode as frequent as possible, to reduce the unconscious injuring on the operator by the long-term blue-light radiation of the high-brightness window of the display. The window-background darkening mode refers to that the theme color of the software window may be configured to be a low-hue low-saturation frame, for example, a light-grey window. The working-page darkening mode refers to that the working page of software such as Word and Excel may be configured to be a low-hue low-saturation frame, for example, an eye-protecting-color page of bean green.

Further optionally, the color temperature may be increased properly based on the preset sunlight color temperature while properly reducing the grayscale brightness by using the ambient brightness, which may satisfy the requirements by people on the brilliance of the frame, and at the same time may ensure that the blue-light radiation amount is not increased considerably.

The displaying-parameter adjusting method according to the embodiments of the present disclosure may facilitate alleviating the injuring on human eyes by the blue light of the displaying device. The method may use the natural optical environment that human being has adapted for a long-term as the harmless comfortable optical environment, use the natural optical environment that is equivalent to the optical environment (background) where the displaying device is located as the adjustment standard, and adjust the corresponding displaying parameter by using a suitable permitted fluctuation range to approach the standard, to implement the effect that the displayed image has no injuring on human eyes and makes a comfortable feeling.

The method, by detecting the ambient brightness, and adjusting the displaying parameter by using the key parameter of the natural light in the equal brightness, enables the radiation-exposure amount that the blue light accounts for to be the standard of the optimum blue-light-component radiation-exposure amount of the displaying device, whereby the average injurious blue-light component entering the eye is less than as much as possible or close to the injurious blue-light component entering the eye of the natural light of the equal brightness, to achieve the effect of displaying that the blue-light component is uninjurious to human eyes and makes a comfortable feeling.

The embodiments of the present disclosure may include firstly detecting an ambient brightness; subsequently determining adjustment parameters of a displaying device corresponding to a predetermined condition, wherein the predetermined condition includes that a difference between a brightness of an intermediate grayscale of the displaying device and the ambient brightness is less than or equal to a preset brightness value; and adjusting a brightness of at least some of grayscales of the displaying device according to the adjustment parameter. In the embodiments of the present disclosure, when the brightness of the intermediate-grayscale of the displayed frame is consistent with the physiological-equilibrium point of the adaptation of the human eye in that environment, the sensing to the frame is more comfortable and more natural. Therefore, the method may use the natural optical environment where the displaying device is located as the adjustment standard, and adjust the corresponding displaying parameter by using a suitable permitted fluctuation range to approach the standard, to implement the effect that the displayed image has no injuring on human eyes and makes a comfortable feeling.

Optionally, the displaying device is provided with a brightness detecting device, and the step 101 may include:

according to target light rays collected by the brightness detecting device, determining the ambient brightness, wherein the target light rays are light rays that are diffusively reflected at a surface of an object around the displaying device.

In a particular implementation, the light entrance of the brightness detecting device may directly face a diffusely reflecting surface, and the solid angle of the incidence of the target light rays from the diffusely reflecting surface to the brightness detecting device may be greater than 1 sr. The diffusely reflecting surface may be a background-wall surface that has undergone diffuse-reflection treatment, a standard white plate, and so on, which is not limited in the present application.

Optionally, the step 101 may include: firstly, acquiring an illuminance value of the diffusely reflecting surface directly facing the displaying device; and subsequently determining a ratio of the illuminance value to $\pi$ as the ambient brightness. In other words, the ambient brightness is the result of division of the illuminance value by $\pi$.

In a particular implementation, due to the measurement on the ambient brightness is complicated and has many influencing factors, in order to obtain an accurate value of the ambient brightness, the displaying device may be calibrated or used in the following several modes. The following illustration takes the case as an example in which the maximum grayscale is 255 and the intermediate grayscale is 127.

In the first method, in a case that the background-wall surface is a relatively ideal diffusely reflecting surface, firstly, an illuminometer may be used to measure the illuminance value of the displaying device facing the background-wall surface. The result obtained by dividing the illuminance value by $\pi$ is the standard brightness that enters the brightness detecting device of the displaying device, and the brightness value detected by the brightness detecting device of the displaying device may be calibrated according to the standard brightness. In the subsequent usage process, the light entrance of the brightness detecting device of the displaying device may directly face the background-wall surface, the brightness detecting device collects the light rays that are diffusively reflected by the background-wall surface, and measures the ambient brightness, and the brightness of the intermediate grayscale of the displaying device is set to be equal to the ambient brightness.

In the second method, when the illuminances at the background-wall surface of the displaying device, the position of the watcher and the position directly facing the displaying device are substantially equal, the light entrance of the brightness detecting device of the displaying device may be aligned with the direction of the watcher, and the measured ambient brightness is configured as the brightness of the intermediate grayscale.

In the third method, the method may include treating the background-wall surface of the displaying device to be a diffusely reflecting surface, or treating a local position that directly faces the light entrance of the brightness detecting device and is not blocked by the displaying device to be a diffusely reflecting surface or a nearly diffusely reflecting surface, and setting the solid angle from the diffuse scattering surface to the brightness detecting device to be as large as possible, to ensure an accurate ambient brightness measured by the brightness detecting device; for example, the solid angle may be greater than 1 sr. In practical applications, the light entrance of the brightness detecting device of the displaying device may directly face the background-wall surface, and it is required to prevent the reflected light of the indoor dome lamp or the other wall surfaces from being blocked and thus not capable to enter the light entrance of the brightness detecting device at the same time; for example, the light entrance of the brightness detecting device may be provided at the top of the displaying device.

In the fourth method, the ambient-brightness detecting device may include a standard white plate configured for reflecting a large amount of ambient light to the light entrance of the ambient-brightness detecting device. Due to the white plate absorbs little light rays, by detecting the brightness of the ambient light reflected by the standard white plate, the accuracy of the detection on the ambient brightness may be increased.

By using one or more of the above methods, an accurate value of the ambient brightness may be obtained.

Optionally, the step 101 may include: based on a prestored correspondence relation between environments and brightnesses, determining a target brightness corresponding to a usage environment of the displaying device; and determining the target brightness to be the ambient brightness.

When the usage environment of the displaying device is a learning-or-official environment, the ambient brightness is a ratio of a target illuminance to $\pi$, wherein the target illuminance is an illuminance value in a horizontal direction at a watching height above a ground by 120 cm.

Regarding a complicated environment, the correspondence relation between the environments and the brightnesses may be determined according to national standards. Particularly, the process may include adjusting the illuminance in the horizontal direction of the ambient light at the watching height to be consistent with that in a national standard, dividing the illuminance by $\pi$, to convert it to be the ambient brightness of the ambient light in the direction directly facing the watcher, and setting the brightness of the intermediate-grayscale of the displaying device to be equal to the ambient brightness. For example, regarding a learning-or-official environment, the national standard is that the illuminance in the perpendicular direction at the height above the ground by 75 cm is 300 lx. Experimentation indicates that the illuminance value in the horizontal direction at the watching height above the ground by 120 cm, i.e., the target illuminance, is usually 200 lx, and the value obtained by dividing 200 lx by it may be configured as the ambient brightness in a learning-or-official environment. Therefore, regarding a learning-or-official environment, the ambient brightness or the target brightness may be set to be 63.7 cd/m$^2$.

Optionally, the process includes, before the installation of the displaying device, measuring the illuminance value at the position of the watching position that directly faces the displaying device to be installed immediately, and using the illuminance value as a reference value; and subsequently, installing the displaying device, and adjusting its grayscale brightness, therefore, in the displayed frame of the intermediate grayscale, for example $L_{127}$, the illuminance value measured at the watching position is equal to the reference value.

Figure 3:
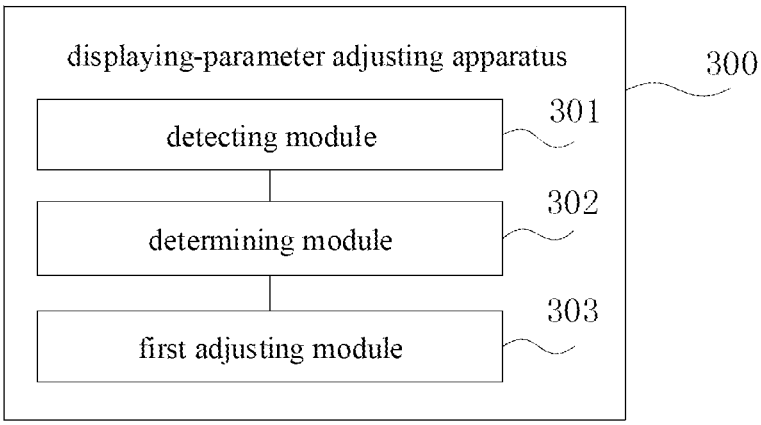
FIG. 3 shows a structural block diagram of the displaying-parameter adjusting apparatus according to an embodiment of the present disclosure.

Referring to FIG. 3, FIG. 3 schematically shows a structural block diagram of a displaying-parameter adjusting apparatus. The apparatus 300 includes:

a detecting module 301 configured for detecting an ambient brightness;

a determining module 302 configured for determining adjustment parameters of a displaying device corresponding to a predetermined condition, wherein the predetermined condition includes that a difference between a brightness of an intermediate grayscale of the displaying device and the ambient brightness is less than or equal to a preset brightness value; and a first adjusting module 303 configured for, according to the adjustment parameter, adjusting a brightness of at least some of grayscales of the displaying device.

Optionally, the determining module includes:

a first determining submodule configured for determining a brightness of a maximum grayscale of the displaying device corresponding to the predetermined condition; and a second determining submodule configured for, according to a preset first correspondence relation between grayscale brightnesses and backlight driving parameters, determining a first backlight driving parameter corresponding to the brightness of the maximum grayscale, and using the first backlight driving parameter as the adjustment parameter.

Optionally, the first adjusting module includes:

a driving submodule configured for, driving a backlight module of the displaying device according to the first backlight driving parameter, so that the difference between the brightness of the intermediate grayscale and the ambient brightness is less than the preset brightness value.

Optionally, when a driving type of the backlight module is voltage driving, the backlight driving parameter is a duty ratio of a driving-voltage signal of the backlight module.

Optionally, when a driving type of the backlight module is current driving, the backlight driving parameter is a driving current of the backlight module.

Optionally, the determining module includes:

a third determining submodule configured for determining a ratio of the ambient brightness to the brightness of the intermediate grayscale before the adjustment, to obtain an adjustment proportion of the displaying device;

a fourth determining submodule configured for determining a product of a first brightness of a target grayscale before the adjustment with the adjustment proportion, to obtain a second brightness of the target grayscale, wherein the target grayscale is any one of grayscales of the displaying device or any one of grayscales to be displayed; and a fifth determining submodule configured for, according to a preset second correspondence relation between the grayscales and the brightnesses before the adjustment, determining an original grayscale corresponding to the second brightness, and using the original grayscale as the adjustment parameter.

Optionally, the first adjusting module includes:

a displaying submodule configured for, displaying at a brightness of the original grayscale when a displaying condition of the target grayscale is satisfied.

Optionally, the displaying submodule is further configured for, displaying at the brightness of the original grayscale when displaying data of a frame to be displayed include the target grayscale.

Optionally, the preset brightness value is greater than or equal to 0.2 times the ambient brightness, and less than or equal to 1.6 times the ambient brightness.

Optionally, the apparatus further includes:

a second adjusting module configured for, adjusting a color temperature of the displaying device according to a preset sunlight color temperature.

Optionally, the second adjusting module includes:

an adjusting submodule configured for adjusting an RGB gain parameter of the displaying device to be a preset RGB gain parameter corresponding to the preset sunlight color temperature.

Optionally, the preset sunlight color temperature is greater than or equal to 6000K, and less than or equal to 7200K.

Optionally, the preset sunlight color temperature is 6700K.

Optionally, the first adjusting module is further configured for:

acquiring a blue-light-radiation-exposure value of the displaying device, wherein the blue-light-radiation-exposure value is for characterizing a level of radiation injury on human eyes by blue light of the displaying device; and according to the adjustment parameter and the blue-light-radiation-exposure value, adjusting the brightness of the at least some of the grayscales of the displaying device, so that the blue-light-radiation-exposure value is less than a preset standard value.

Optionally, the preset standard value is 1 $W/m^2$.

Optionally, the first adjusting module is further configured for: calculating the blue-light-radiation-exposure value by using the following formula:

$L_B=\Sigma_{300}^{700} L_\lambda \cdot B(\lambda) \cdot L\lambda$, wherein $L_B$ is the blue-light-radiation-exposure value, $\lambda$ is a wavelength of a scanning spectrum, a value of $\lambda$ is greater than or equal to 300 nm, and less than or equal to 700 nm, $L_\lambda$ is a radiation brightness of a light whose wavelength is $\lambda$, $B(\lambda)$ is a preset coefficient of the light whose wavelength is $\lambda$, and $\Delta\lambda$ is a scanning interval of spectrum scanning.

Optionally, the displaying device is provided with a brightness detecting device, and the detecting module is further configured for:

according to target light rays collected by the brightness detecting device, determining the ambient brightness, wherein the target light rays are light rays that are diffusively reflected at a surface of an object around the displaying device.

Optionally, a light entrance of the brightness detecting device directly faces a diffusely reflecting surface, and a solid angle of incidence of the target light rays from the diffusely reflecting surface to the brightness detecting device is greater than 1 sr.

Optionally, the detecting module is further configured for:

acquiring an illuminance value of the diffusely reflecting surface directly facing the displaying device: and determining a ratio of the illuminance value to $\pi$ as the ambient brightness.

Optionally, the detecting module is further configured for, based on a pre-stored correspondence relation between environments and brightnesses, determining a target brightness corresponding to a usage environment of the displaying device; and determining the target brightness to be the ambient brightness.

Optionally, when the usage environment of the displaying device is a learning-or-official environment, the ambient brightness is a ratio of a target illuminance to $\pi$, wherein the target illuminance is an illuminance value in a horizontal direction at a watching height above a ground by 120 cm.

Optionally, the target illuminance is 200 lx.

The embodiments of the present disclosure may include firstly by using the detecting module, detecting an ambient brightness; subsequently by using the determining module, determining adjustment parameters of a displaying device corresponding to a predetermined condition, wherein the predetermined condition includes that a difference between a brightness of a intermediate grayscale of the displaying device and the ambient brightness is less than or equal to a preset brightness value; and by using the first adjusting module, according to the adjustment parameter, adjusting a brightness of at least some of grayscales of the displaying device. In the embodiments of the present disclosure, when the brightness of the intermediate-grayscale of the displayed frame is consistent with the physiological-equilibrium point of the adaptation of the human eyes in that environment, the sensing to the frame is more comfortable and more natural. Therefore, the apparatus may use the natural optical environment where the displaying device is located as the adjustment standard, and adjust the corresponding displaying parameter by using a suitable permitted fluctuation range to approach the standard, to realize the effect that the displayed image has no injuring on human eyes and makes a comfortable feeling.

The present disclosure further provides a displaying device, wherein the displaying device performs displaying-parameter adjustment by using the displaying-parameter adjusting method stated above.

Optionally, the displaying device includes a backlight module, and a ratio of a sum of powers of first light-source wave bands of a light source of the backlight module to a sum of powers of second light-source wave bands of a light source of the backlight module is less than 50%; and the first light-source wave bands are greater than or equal to 415 nm, and less than or equal to 455 nm, and the second light-source wave bands are greater than or equal to 400 nm, and less than or equal to 500 nm.

In other words, optionally, the peak value of the blue-light light source of the backlight module is moved in the direction of the long wave, and the quotient obtained by dividing the sum of the powers of the blue lights in its wave band of 415 nm-455 nm by the sum of the powers of the blue lights in the wave band of 400 nm-500 nm is less than 50%. Due to the blue light that has the major injuring on human eyes is mainly the short-wavelength blue light, moving the peak value of the blue-light light source of the backlight module in the direction of the long wave may reduce the radiation amount of the short-wavelength blue light to human eyes, which reduces the radiation amount of the short-wavelength blue light that reaches the retina, thereby reducing the injuring on the human eyes by the short-wavelength blue light, whereby the displaying device may satisfy the eye-protection certification standards such as VDE (the low-blue-light eye-protection certification of the Prufstelle Testing and Certification Institute).

Moving the peak value of the blue-light light source of the backlight module in the direction of the long wave may be implemented by adjusting the composition of the phosphor powders in the light source of the backlight module. The proportion of the phosphor powder that emits blue light may be reduced, whereby the radiation amount of the short-wavelength blue light of the light source may be reduced.

By testing the powers of the prototype before and after the light source is improved, the testing result shown in in the following Table 1 may be obtained.

TABLE 1

| prototype | peak wave-length | power sum P1 of wave band 415 nm-455 nm | power sum P2 of wave band 400 nm-500 nm | P1/P2 |
|---|---|---|---|---|
| before improvement | 450 nm | 0.1944 | 0.3562 | 54.6% |
| improvement 1 | 457 nm | 0.1037 | 0.2995 | 34.6% |
| improvement 2 | 460 nm | 0.1369 | 0.5193 | 26.4% |

It may be known according to Table 1 that, after the peak value of the blue-light light source is moved in the direction of the long wave, the proportion of the injurious short-wavelength blue light is reduced, and the proportion of the injurious blue light is reduced with the increasing of the peak wavelength. The color temperature of the sample is ≤9600K, which may be implemented within the whole of the current range of the color temperature of the displaying device.

It should be noted that the data in Table 1 do not form a limitation on the present disclosure.

In the embodiments of the present disclosure, the displaying device performs displaying-parameter adjustment by using the displaying-parameter adjusting method stated above. The process may include firstly detecting an ambient brightness; subsequently determining adjustment parameters of a displaying device corresponding to a predetermined condition, wherein the predetermined condition includes that a difference between a brightness of an intermediate grayscale of the displaying device and the ambient brightness is less than or equal to a preset brightness value; and adjusting a brightness of at least some of grayscales of the displaying device according to the adjustment parameter. In the embodiments of the present disclosure, when the brightness of the intermediate-grayscale of the displayed frame is consistent with the physiological-equilibrium point of the adaptation of the human eyes in that environment, the sensing to the frame is more comfortable and more natural. Therefore, the displaying device may use the natural optical environment where the displaying device is located as the adjustment standard, and adjust the corresponding displaying parameter by using a suitable permitted fluctuation range to approach the standard, to realize the effect that the displayed image has no injuring on human eyes and makes a comfortable feeling. Furthermore, the ratio of the sum of the powers of the first light-source wave bands of the light source of the backlight module of the displaying device to the sum of the powers of the second light-source wave bands of the light source of the backlight module is less than 50%, which may reduce the proportion of the short-wavelength blue light, thereby further reducing the injuring on the human eye by the blue light.

Regarding the above-described process embodiments, for brevity of the description, all of them are expressed as the combination of a series of actions, but a person skilled in the art should know that the present disclosure is not limited by the sequences of the actions that are described, because, according to the present disclosure, some of the steps may have other sequences or be performed simultaneously. Secondly, a person skilled in the art should also know that all of the embodiments described in the description are optional embodiments, and not all of the actions and the modules that they involve are required by the present disclosure.

The embodiments of the description are described in the mode of progression, each of the embodiments emphatically describes the differences from the other embodiments, and the same or similar parts of the embodiments may refer to each other.

Finally, it should also be noted that, in the present text, relation terms such as first and second are merely intended to distinguish one entity or operation from another entity or operation, and that does not necessarily require or imply that those entities or operations have therebetween any such actual relation or order. Furthermore, the terms "include", "include" or any variants thereof are intended to cover non-exclusive inclusions, so that processes, methods, articles or devices that include a series of elements do not only include those elements, but also include other elements that are not explicitly listed, or include the elements that are inherent to such processes, methods, articles or devices. Unless further limitation is set forth, an element defined by the wording "comprising a . . . " does not exclude additional same element in the process, method, article or device comprising the element.

The displaying-parameter adjusting method and apparatus and the displaying device according to the present disclosure have been described in detail above. The principle and the embodiments of the present disclosure are described herein with reference to the particular examples, and the description of the above embodiments is merely intended to facilitate to understand the method according to the present disclosure and its core concept. Moreover, for a person skilled in the art, according to the concept of the present disclosure, the particular embodiments and the range of application may be varied. In conclusion, the contents of the description should not be understood as limiting the present disclosure.

The above-described device embodiments are merely illustrative, wherein the units that are described as separate components may or may not be physically separate, and the components that are displayed as units may or may not be physical units: in other words, they may be located at the same one location, and may also be distributed to a plurality of network units. Some or all of the modules may be selected according to the actual demands to realize the purposes of the solutions of the embodiments. A person skilled in the art may understand and implement the technical solutions without paying creative work.

Each component embodiment of the present disclosure may be implemented by hardware, or by software modules that are operated on one or more processors, or by a combination thereof. A person skilled in the art should understand that some or all of the functions of some or all of the components of the calculating and processing device according to the embodiments of the present disclosure may be implemented by using a microprocessor or a digital signal processor (DSP) in practice. The present disclosure may also be implemented as apparatus or device programs (for example, computer programs and computer program products) for implementing part of or the whole of the method described herein. Such programs for implementing the present disclosure may be stored in a computer-readable medium, or may be in the form of one or more signals. Such signals may be downloaded from an Internet website, or provided on a carrier signal, or provided in any other forms.

The present disclosure further provides a calculating and processing device, wherein the calculating and processing device includes:

a memory storing a computer-readable code; and one or more processors, wherein when the computer-readable code is executed by the one or more processors, the calculating and processing device implements each of the steps of the method described above.

The present disclosure further provides a computer program, wherein the computer program includes a computer-readable code, and when the computer-readable code is executed in a calculating and processing device, the computer-readable code causes the calculating and processing device to implement each of the steps of the method described above.

The present disclosure further provides a nonvolatile computer-readable storage medium, wherein the nonvolatile computer-readable storage medium stores the computer program stated above.

Figure 4:
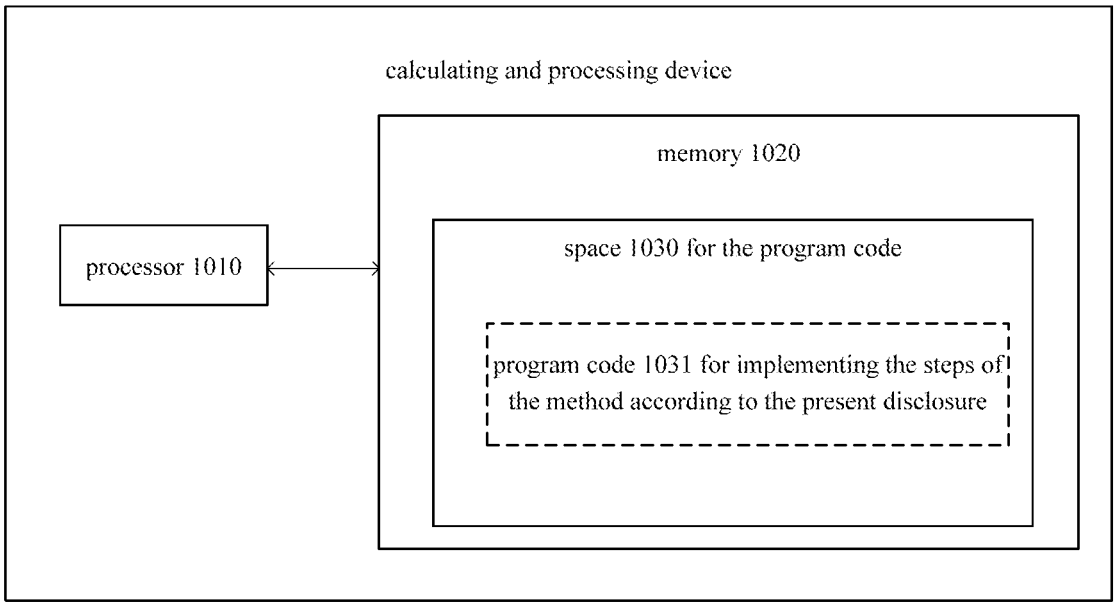
FIG. 4 shows a block diagram of a calculating and processing device for implementing the method according to the present disclosure.
Figure 5:
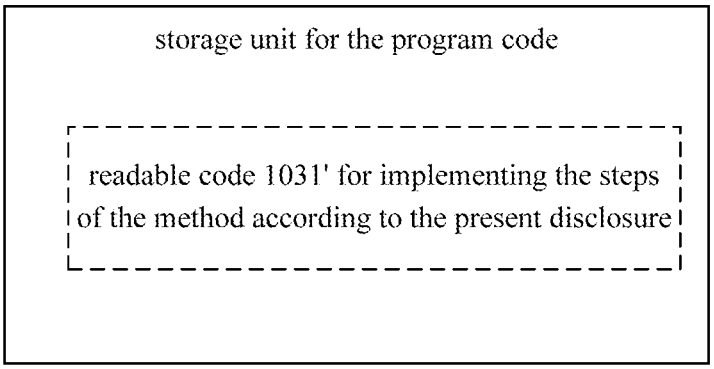
FIG. 5 shows a storage unit for maintaining or carrying a program code for implementing the method according to the present disclosure.

For example, FIG. 4 shows a calculating and processing device that may implement the method according to the present disclosure. The calculating and processing device traditionally includes a processor 1010 and a computer program product or computer-readable medium in the form of a memory 1020. The memory 1020 may be electronic memories such as flash memory, EEPROM (Electrically Erasable Programmable Read Only Memory), EPROM, hard disk or ROM. The memory 1020 has the storage space 1030 of the program code 1031 for implementing any steps of the above method. For example, the storage space 1030 for program code may include program codes 1031 for individually implementing each of the steps of the above method. Those program codes may be read from one or more computer program products or be written into the one or more computer program products. Those computer program products include program code carriers such as a hard disk, a compact disk (CD), a memory card or a floppy disk. Such computer program products are usually portable or fixed storage units as shown in FIG. 5. The storage unit may have storage segments or storage spaces with similar arrangement to the memory 1020 of the calculating and processing device in FIG. 4. The program codes may, for example, be compressed in a suitable form. Generally, the storage unit includes a computer-readable code 1031', which may be read by a processor like 1010. When those codes are executed by the calculating and processing device, the codes cause the calculating and processing device to implement each of the steps of the method described above.

The "one embodiment", "an embodiment" or "one or more embodiments" as used herein means that particular features, structures or characteristics described with reference to an embodiment are included in at least one embodiment of the present disclosure. Moreover, it should be noted that here an example using the wording "in an embodiment" does not necessarily refer to the same one embodiment.

The description provided herein describes many concrete details. However, it may be understood that the embodiments of the present disclosure may be implemented without those concrete details. In some of the embodiments, well-known processes, structures and techniques are not described in detail, so as not to affect the understanding of the description.

In the claims, any reference signs between parentheses should not be construed as limiting the claims. The word "include" does not exclude elements or steps that are not listed in the claims. The word "a" or "an" preceding an element does not exclude the existing of a plurality of such elements. The present disclosure may be implemented by means of hardware comprising several different elements and by means of a properly programmed computer. In unit claims that list several devices, some of those devices may be embodied by the same item of hardware. The words first, second, third and so on do not denote any order. Those words may be interpreted as names.

Finally, it should be noted that the above embodiments are merely intended to explain the technical solutions of the present disclosure, and not to limit them. Although the present disclosure is explained in detail with reference to the above embodiments, a person skilled in the art should understand that he may still modify the technical solutions set forth by the above embodiments, or make equivalent substitutions to part of the technical features of them. However, those modifications or substitutions do not make the essence of the corresponding technical solutions depart from the spirit and scope of the technical solutions of the embodiments of the present disclosure.

The invention claimed is:

1. A displaying-parameter adjusting method, wherein the method comprises:

detecting an ambient brightness;

determining an adjustment parameter of a displaying device corresponding to a predetermined condition, wherein the predetermined condition comprises that a difference between a brightness of an intermediate grayscale of the displaying device and the ambient brightness is less than or equal to a preset brightness value; and adjusting a brightness of at least one of grayscales of the displaying device according to the adjustment parameter;

wherein the step of, adjusting the brightness of the at least some of the grayscales of the displaying device according to the adjustment parameter comprises:

acquiring a blue-light-radiation-exposure value of the displaying device, wherein the blue-light-radiation-exposure value is configured for characterizing a level of radiation injury on human eyes by blue light of the displaying device; and adjusting the brightness of the at least some of the grayscales of the displaying device according to the adjustment parameter and the blue-light-radiation-exposure value, to make the blue-light-radiation-exposure value is less than a preset standard value;

wherein the step of acquiring the blue-light-radiation-exposure value of the displaying device comprises: calculating the blue-light-radiation-exposure value by using the following formula:

$$L_B=\Sigma_{300}^{700} L_\lambda \cdot B(\lambda)\cdot\Delta\lambda,$$

wherein $L_B$ is the blue-light-radiation-exposure value, $\lambda$ is a wavelength of a scanning spectrum, a value of $\lambda$ is greater than or equal to 300 nm, and less than or equal to 700 nm, $L_\lambda$ is a radiation brightness of a light whose wavelength is $\lambda$, $B(\lambda)$ is a preset coefficient of the light whose wavelength is $\lambda$, and $\Delta\lambda$ is a scanning interval of spectrum scanning.

2. The method according to claim 1, wherein the step of determining the adjustment parameter of the displaying device corresponding to the predetermined condition comprises:

determining a brightness of a maximum grayscale of the displaying device corresponding to the predetermined condition; and according to a preset first correspondence relation between grayscale brightnesses and backlight driving parameters, determining a first backlight driving parameter corresponding to the brightness of the maximum grayscale, and using the first backlight driving parameter as the adjustment parameter.

3. The method according to claim 2, wherein the step of, adjusting the brightness of the at least some of the grayscales of the displaying device according to the adjustment parameter comprises:

driving a backlight module of the displaying device according to the first backlight driving parameter, to make the difference between the brightness of the intermediate grayscale and the ambient brightness less than the preset brightness value.

4. The method according to claim 3, wherein when a driving type of the backlight module is voltage driving, the backlight driving parameter is a duty ratio of a driving-voltage signal of the backlight module.

5. The method according to claim 3, wherein when a driving type of the backlight module is current driving, the backlight driving parameter is a driving current of the backlight module.

6. The method according to claim 1, Wherein the step of determining the adjustment parameter of the displaying device corresponding to the predetermined condition comprises:

determining a ratio of the ambient brightness to the brightness of the intermediate grayscale before the adjustment, to obtain an adjustment proportion of the displaying device;

determining a product of a first brightness of a target grayscale before the adjustment with the adjustment proportion, to obtain a second brightness of the target grayscale, wherein the target grayscale is any one of grayscales of the displaying device or any one of grayscales to be displayed; and according to a preset second correspondence relation between the grayscales and the brightnesses before the adjustment, determining an original grayscale corresponding to the second brightness, and using the original grayscale as the adjustment parameter.

7. The method according to claim 6, wherein the step of, adjusting the brightness of the at least some of the grayscales of the displaying device comprises according to the adjustment parameter:

displaying at a brightness of the original grayscale when a displaying condition of the target grayscale is satisfied.

8. The method according to claim 7, wherein the step of, displaying at a brightness of the original grayscale when a displaying condition of the target grayscale is satisfied comprises:

displaying at the brightness of the original grayscale when displaying data of a frame to be displayed comprise the target grayscale.

9. The method according to claim 1, wherein the preset brightness value is greater than or equal to 0.2 times the ambient brightness, and less than or equal to 1.6 times the ambient brightness.

10. The method according to claim 1, wherein the method further comprises:

adjusting a color temperature of the displaying device according to a preset sunlight color temperature.

11. The method according to claim 10, wherein the step of, adjusting a color temperature of the displaying device according to a preset sunlight color temperature comprises:

adjusting an RGB gain parameter of the displaying device to be a preset RGB gain parameter corresponding to the preset sunlight color temperature.

12. The method according to claim 1, wherein the displaying device is provided with a brightness detecting device, and the step of detecting the ambient brightness comprises:

determining the ambient brightness according to target light rays collected by the brightness detecting device, wherein the target light rays are light rays that are diffusively reflected at a surface of an object around the displaying device.

13. The method according to claim 12, wherein a light entrance of the brightness detecting device directly faces a diffusely reflecting surface, and a solid angle of incidence of the target light rays from the diffusely reflecting surface to the brightness detecting device is greater than 1 sr.

14. The method according to claim 1, wherein the step of detecting the ambient brightness comprises:

acquiring an illuminance value of the diffusely reflecting surface directly facing the displaying device; and determining a ratio of the illuminance value to 7E as the ambient brightness.

15. The method according to claim 1, wherein the step of detecting the ambient brightness comprises:

based on a pre-stored correspondence relation between environments and brightnesses, determining a target brightness corresponding to a usage environment of the displaying device; and determining the target brightness to be the ambient brightness.

16. The method according to claim 15, wherein when the usage environment of the displaying device is a learning-or-official environment, the ambient brightness is a ratio of a target illuminance to $\pi$, wherein the target illuminance is an illuminance value in a horizontal direction at a watching height above a ground by 120 cm.

17. A displaying device, wherein the displaying device performs displaying-parameter adjustment by using the displaying-parameter adjusting method according to claim 1.

18. The displaying device according to claim 17, wherein the displaying device comprises a backlight module, and a ratio of a sum of powers of first light-source wave bands of a light source of the backlight module to a sum of powers of second light-source wave bands of the light source of the backlight module is less than 50%; and the first light-source wave bands are greater than or equal to 415 nm, and less than or equal to 455 nm, and the second light-source wave bands are greater than or equal to 400 nm, and less than or equal to 500 nm.

* * * * *